United States Patent [19]

Grossman

[11] 3,953,991

[45] May 4, 1976

[54] LOCK CONSTRUCTION

[75] Inventor: Paul M. Grossman, Freehold, N.J.

[73] Assignees: Albert M. Stein, Scarsdale; Vincent G. Siliato, Brooklyn, both of N.Y.; Paul Grossman, Freehold, N.J.; Elliot Daskal, Suffern, N.Y.

[22] Filed: Aug. 15, 1974

[21] Appl. No.: 497,518

[52] U.S. Cl. ..... 70/104; 70/279; 70/282; 70/465; 292/159; 292/170; 292/333; 292/DIG. 65

[51] Int. Cl.[2] ..... E05B 47/04; E05B 63/12; E05B 63/20; E05C 1/06

[58] Field of Search ..... 70/92, 102–106, 70/157, 277–279, 282, 465; 292/92, 159, 169.15, 169.16, 170, 172, 332, 333, DIG. 25, DIG. 65

[56] References Cited

UNITED STATES PATENTS

| | | | |
|---|---|---|---|
| 1,736,761 | 11/1929 | Haffner | 70/282 |
| 1,998,246 | 4/1935 | Ledin et al. | 70/105 |
| 2,105,350 | 1/1938 | FitzGerald | 292/144 |
| 2,241,872 | 5/1941 | Van Note | 292/DIG. 25 |
| 2,541,461 | 2/1951 | Churchill | 70/282 |
| 3,168,737 | 2/1965 | Weinstein | 70/277 |
| 3,392,559 | 7/1968 | Hedin et al. | 70/277 |
| 3,725,939 | 4/1973 | Saltzstein | 70/277 |
| 3,772,574 | 11/1973 | Hughes | 70/278 X |
| 3,828,592 | 8/1974 | Horgan | 292/170 X |

FOREIGN PATENTS OR APPLICATIONS

| | | | |
|---|---|---|---|
| 2,103,408 | 8/1972 | Germany | 292/169.16 |
| 345,072 | 12/1936 | Italy | 292/332 |

*Primary Examiner*—Paul R. Gilliam
*Assistant Examiner*—Carl F. Pietruszka
*Attorney, Agent, or Firm*—Ryder, McAulay, Fields, Fisher & Goldstein

[57] ABSTRACT

A radio-operated lock construction is adapted to be mounted on a door and is positioned to engage a mating piece mounted on the adjacent door jamb to lock the door in the closed position. The lock comprises a lock housing having means for mounting the housing on the door. A drop bolt is movably mounted on the housing for movement between an extended position wherein the bolt engages with the mating piece and a retracted position wherein the bolt and mating piece are disengaged. The drop bolt comprises an operating member which is movable from a first position corresponding to the extended position of the bolt to a second position corresponding to the retracted position of the bolt. An opening slide is connected with the operating member and is movable upon actuation from a first to a second position to move the operate member from the first to the second position thereby retracting the drop bolt. A retainer in the form of a reciprocating plate is responsive to the movement of the opening slide to the second position to retain the operating member in its second position. Actuating means is connected to the opening slide for actuating the opening slide.

The actuating device comprises a receiver responsive to the reception of a preselected signal for operating the opening slide whereby external openings on the face or front of the door for a key or the like are eliminated.

14 Claims, 12 Drawing Figures

LOCK CONSTRUCTION

The present invention relates generally to a lock construction and, more particularly, relates to a lock construction that may be operated remotely by the use of radio signals.

BACKGROUND OF THE INVENTION

The rate of occurence of crime in the United States and elsewhere is increasing at an alarming rate. In an effort to ensure at least minimum safeguards against unauthorized intrusion, people are utilizing so-called anti-theft locks since conventional tumbler-operated locks or the like can easily be defeated. For example, it is a relatively easy matter to pick conventional tumbler-operated locks or to insert a blade between the lock and the door jamb and thereby force open the lock. Various types of anti-theft locks have been proposed in the past such as magnetically-operated locks, pick-proof locks that require keys having knotches on the bottom as well as the top edges, etc. However, these locks all suffer from the same disadvantage in that they provide openings for the insertion of a key or an operating member and they thereby provide a thief with opportunity to pick the lock through the opening.

Accordingly, an object of the present invention is to provide an improved lock construction.

A more specific object of this aspect of the invention is to provide a lock construction that eliminates the need for an external member to operate the lock.

A further object of the invention is the provision of a lock construction that is operated in response to radio signals having a selected predetermined characteristic.

Another object of the invention resides in the novel details of construction that provide a lock of the type described that is extremely reliable in operation and wherein different locks may be made responsive to a different predetermined characteristic of the transmitted signal to virtually eliminate the possibility of false operation of the lock by unauthorized personnel.

A major feature and advantage of the present construction is that there is no provision for access to the lock mechanism from the face or front of the door thereby eliminating any possibility of someone being able to pick the lock. However, it is imperative, of course, that the lock be operated to the closed state when the door is shut.

Accordingly, an object of this aspect of the invention is to provide a novel arrangement that automatically insures operation of the lock to the closed state upon closure of the door. Inherent in this arrangement, therefore, is the elimination of any possibility of someone forgetting to lock the door.

SUMMARY OF THE INVENTION

Accordingly, a lock construction is made according to the present invention comprises a lock mechanism for a door that is adapted to engage a mating piece to lock the door. The lock mechanism comprises a lock housing which moveably mounts bolt means for movement between an extended position wherein the bolt means engages with the mating piece, and a retracted position wherein the bolt means and the mating piece are disengaged. The bolt means comprises an operating member moveable from a first position corresponding to the extended position of the bolt means to a second position corresponding to the retracted position of the bolt means. Opening means is connected with the operating member and is movable upon actuation from a first to a second position to move the operating member from the inoperate to the operate position thereby disengaging the bolt means from the mating piece. Retaining means is provided which is responsive to the movement of the opening means to the second position for retaining the operating member in the operate position. Actuating means is connected to the opening means for actuating the opening means to permit a person to open the door.

BRIEF DESCRIPTION OF THE DRAWINGS

Other features and advantages of the present invention will become more apparent from a consideration of the following detailed description when taken in conjunction with the accompanying drawings, in which.

DESCRIPTION OF THE PREFERRED EMBODIMENT

Figure 2:
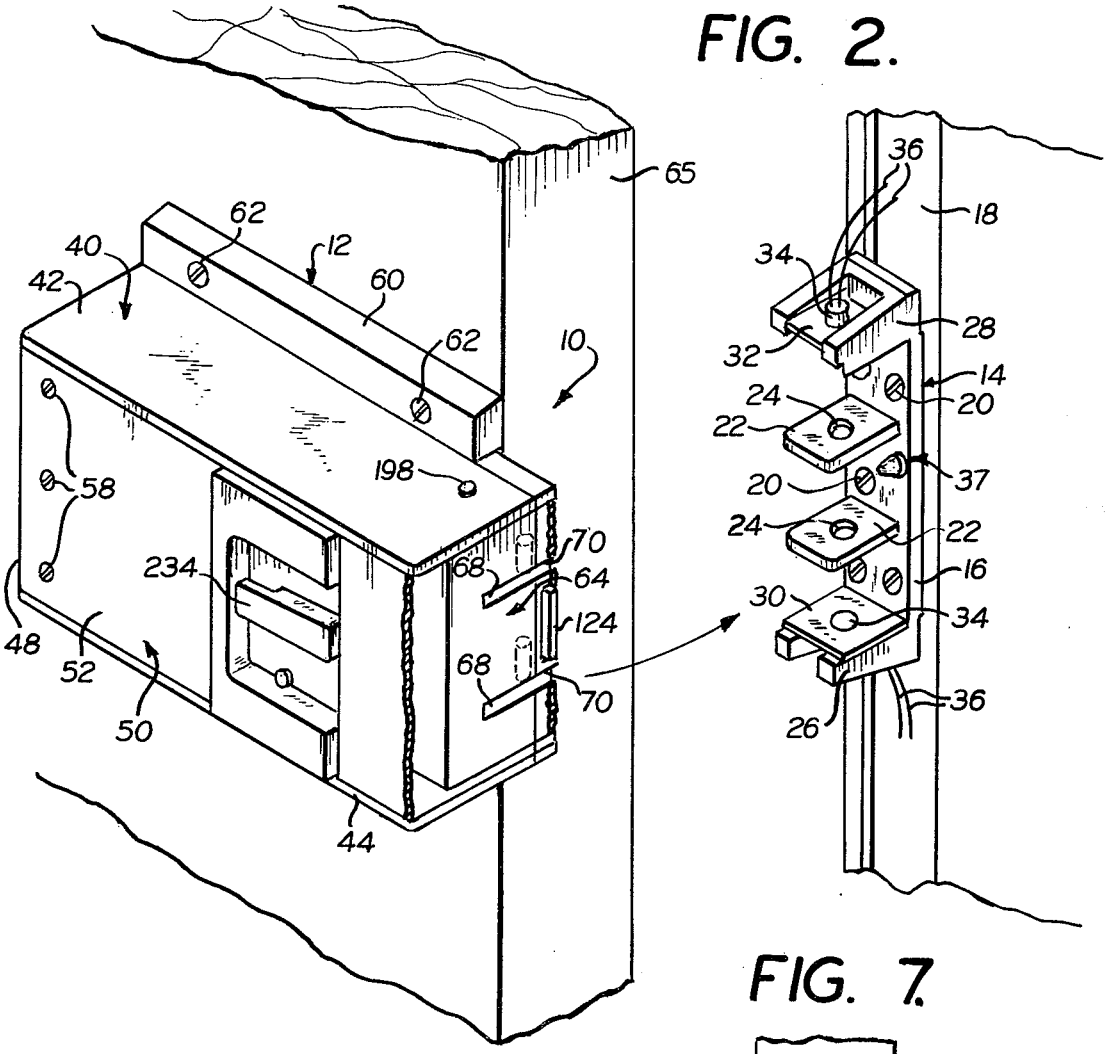
FIG. 2 is a perspective view illustrating the relationship between the lock mechanism and the mating piece of the lock construction of the present invention.

The lock of the present invention is designated generally by the reference character 10 in FIG. 2 and comprises a radio-operated lock mechanism designated generally by the reference character 12 and a mating piece designated generally by the reference character 14. Generally speaking, the lock mechanism 12 includes a drop bolt that is adapted to engage the mating piece to lock a door in the closed position. Unlocking of the lock is accomplished by transmitting a signal having preselected characteristics to the lock mechanism. Enclosed within the lock mechanism housing is a receiver having means for detecting the predetermined characteristics of the transmitted signal and for retracting the bolt to disengage the lock mechanism from the mating piece thereby permitting the door to be opened. Since the lock is operated remotely by radio signals, the need for access to the lock from the face or front of the door is completely eliminated in comparison to locks requiring external members for their operation such as key-operated locks. As a result, the lock construction of the present invention, for all intents and purposes, cannot be operated by unauthorized personnel since it cannot be picked in the conventional manner.

In view of the fact that the lock mechanism is inaccessable from the front or face of the door on which the mechanism is mounted, novel means are provided to ensure operation of the lock construction to the locked state upon closure of the door. In particular, and as noted in greater detail below, a projecting member or plate is operable to retain the bolt mechanism in the retracted or open position until the door is closed. The bolt mechanism is then released so that it can engage the mating piece thereby to securely lock the door against unauthorized intruders. This arrangement may also be utilized in conventional locks where automatic operation of the lock is desired upon closure of the door.

More specifically, the mating piece 14 of the lock 10 comprises a base plate 16 which is adapted to abut a door jamb 18. Screws 20 pass through apertures in the base plate and firmly affix the plate to the door jamb. Projecting outwardly from the base plate 16 are vertically spaced ears 22 having respective apertures 24 therethrough. The apertures 24 receive the bolt mechanism posts of the lock mechanism 12 in the conventional manner when the lock is in the locked state thereby to securely lock the door in the closed position.

The base plate 16 is also provided with upstanding ears 26 and 28 at each end thereof. Mounted on the ears 26 and 28 are respective insulating pads 30 and 32 which, in turn, receive conventional ball contacts 34. That is, the contacts 34 are biased outwardly by spring means (not shown). The contacts 34 are connected to a source of power (not shown in FIG. 2) by a lead 36. As noted in greater detail below, the contacts 34 are adapted to engage respective terminals of the lock mechanism 12 to connect the electric circuitry within the lock mechanism to the source of power, thereby to energize the same.

Also provided on the base plate 16 is a striker 37 that is positioned between the ears 22. The striker comprises a conical projection 38 (FIG. 10) on a reduced diameter post 39, the operation of which is described in greater detail below.

Figure 4:
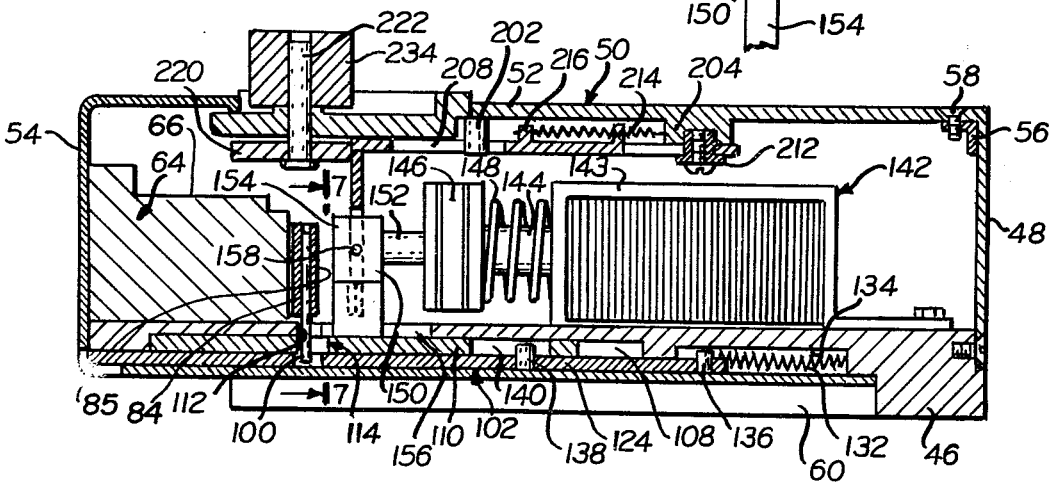
FIG. 4 is a vertical longitudinal sectional view of the lock mechanism shown in FIG. 2.

The lock mechanism 12 includes a housing 40 having side walls 42 and 44, a bottom wall 46 and a rear wall 48. A cover plate 50 is provided to close the opening defined by the aforementioned walls. Accordingly, the cover plate 50 provides a top wall 52 and a front wall 54 (FIG. 4). An L-shaped bracket 56 is provided adjacent the upper edge of the end wall 48 and threadedly receives screws 58 therein which extend through the cover plate 50 to affix the cover plate in place.

The bottom wall 46 is provided with mounting members 60 which extend beyond the respective side walls 42 and 44 and which receive screws 62 therethrough to fixedly mount the lock mechanism 12 on a door 65. The lock mechanism 12 is positioned so that it will mate with the mating piece 14.

Figure 3:
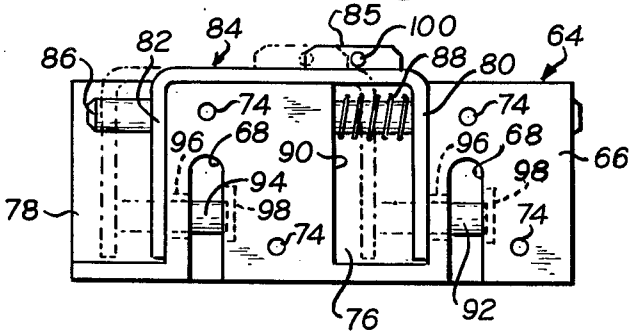
FIG. 3 is a bottom plan view of the bolt mechanism portion of the lock mechanism shown in FIG. 2.

Received within the housing 40 adjacent the wall 54 is a bolt mechanism designated generally by the reference character 64. The bolt mechanism 64, as shown in FIG. 3, comprises a mounting block 66 having vertically spaced open ended slots 68 therein which are aligned with corresponding slots 70 (FIG. 2) in the bottom wall 46. When the door 65 is closed, the ears 22 on the mating piece 14 are received within each one of the pairs of aligned slots 68, 70. The bolt mechanism 64 is affixed in place by screws 72 that pass through countersunk bores in the bottom wall 46 (FIG. 5A) and are engaged in threaded openings 74 in the mounting block 66.

Upwardly extending recesses 76 and 78 are provided in the mounting block 66 which respectively receive the legs 80 and 82 of a U-shaped member 84. The U-shaped member 84 is mounted for sliding movement on a shaft 86 that extends through appropriate apertures in the legs 80 and 82 and aligned apertures in the mounting block 66. A spring 88 is provided on the shaft 86 which abuts the leg 80 at one end and a wall 90 forming one end of the recess 76 at the other end to bias the U-shaped member 84 to the position shown by the solid line drawing of FIG. 3.

Affixed to the ends of the legs 80 and 82 are respective upstanding posts 92 and 94. The posts 92 and 94 are slidably received in apertures 96 in the block 66. In the normal position of the bolt mechanism, as shown by the solid line drawing of FIG. 3, the respective posts 92 and 94 are in the so-called extended position and bridge the slots 68 and are received in recesses 98 at their free end. This position corresponds to the closed state of the lock. However, the U-shaped member 84 may be moved to the position shown by the phantom line drawing of FIG. 3 whereby the posts 92 and 94 are spaced or withdrawn from the slot 68. This latter position corresponds to the retracted position of the bolt mechanism or to the unlocked state of the lock. Thus, when the ears 22 of the mating piece 14 are received in the slots 68, the posts 92 and 94 extend through the respective apertures 24 thereby to cause engagement of the lock mechanism with the mating piece. Movement of the bolt mechanism to the retracted position will affect disengagement of the lock mechanism from the mating piece. Under normal conditions, the spring 88 will bias the U-shaped member 84 to the position shown by the solid line drawing of FIG. 3 thereby causing the lock 10 to normally assume a locked state.

Connected to the bight portion of the U-shaped member 84 by an extension 85 is a pin 100. As shown in FIG. 4, the pin 100 extends beyond the surface of the mounting block 66 and is adapted to be moved by an opening assembly designated generally by the reference numeral 102 to cause concomitant movement of the U-shaped member 84 and the posts 92 and 94 to the retracted position or open state of the lock. Thus, the pin 100 may be considered to be an operating member which is movable from the solid line or first position shown in FIG. 3 to the phantom line or second position shown in FIG. 3 to cause corresponding movement of the posts 92 and 94 to the retracted position.

Figures 5A, 5B, 5C, 8, 9, 10:
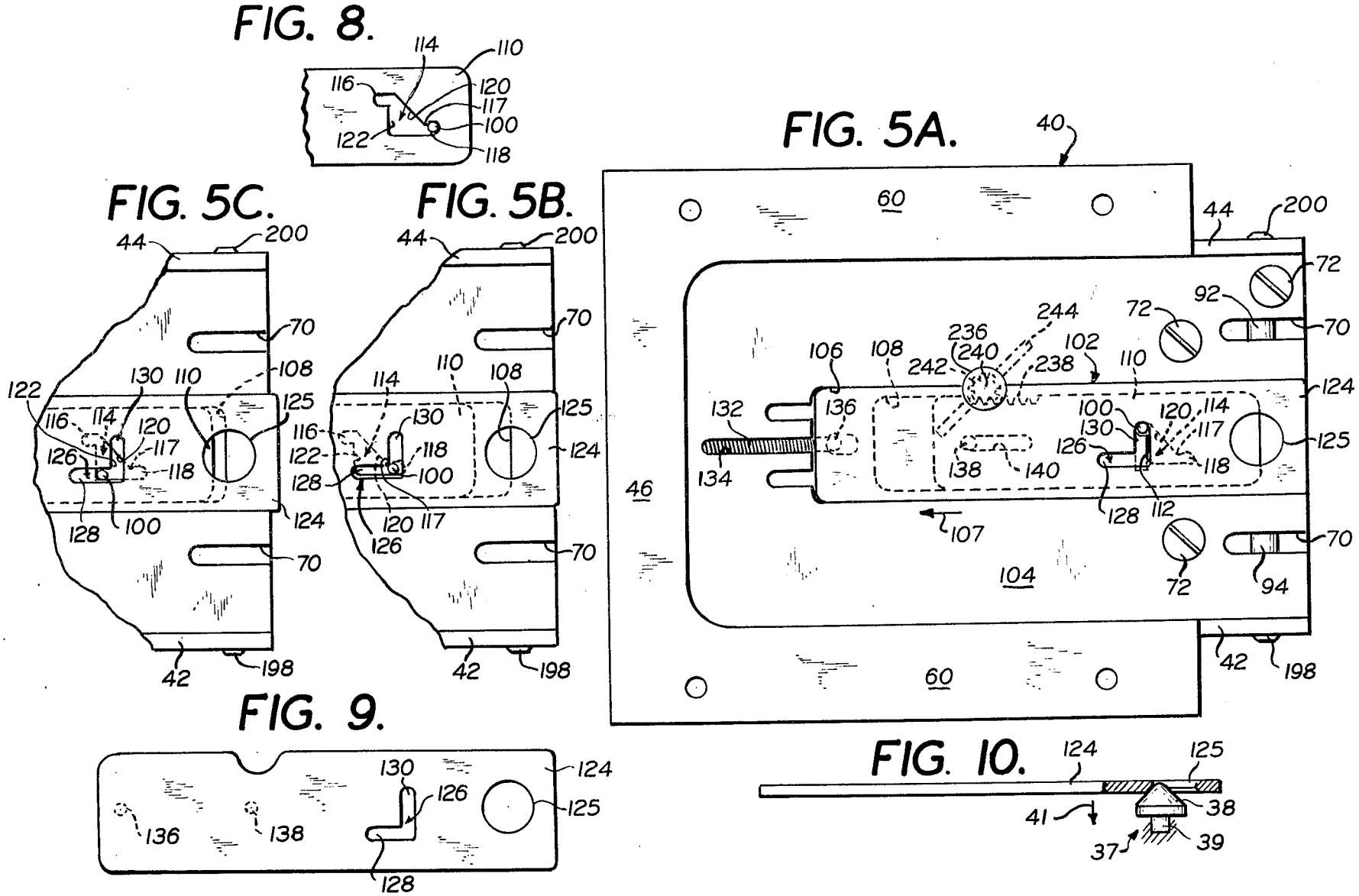
FIG. 5A is an inverted bottom plan view of the bolt mechanism opening assembly illustrating the position of the elements when the lock is in the locked state.
FIG. 5B is a detail view of a portion of the opening assembly illustrated in FIG. 5A, showing the relative positions of the elements immediately after the operation of the lock to the unlocked state.
FIG. 5C is a detail view similar to FIG. 5B, showing the position of the elements subsequent to the opening of the door, after the lock has been operated to the unlocked state.
FIG. 8 is a detail view, with parts removed and broken away, of the opening member of the lock construction.
FIG. 9 is a bottom plan view of the retaining slide portion of the lock construction.
FIG. 10 is a side elevational view, partially in section, of the retaining slide and striker.

As shown in FIG. 5A, which illustrates the lock in inverted position with respect to FIG. 2, the bottom wall 46 of the housing 40 is recessed at 104 and the bottom wall of the recess 104 is provided with a centrally located open ended recess 106 which, in turn, is provided with a recess 108. The opening assembly 102 is disposed in the recesses 106 and 108.

More specifically, the opening assembly 102 includes an opening slide 110 disposed for sliding movement within the recess 108. That is, the longitudinal dimension of the slide 110 is smaller than the longitudinal dimension of the recess 108 so that the slide may move rearwardly in the recess 108 from the position shown in FIG. 5A. As shown in FIGS. 4, 5A and 8, the pin 100 of the bolt mechanism 64 extends through a transverse slot 112 in the bottom wall 46 and is received through a slot 114 in the slide 110. The slot 114 includes respective rearwardly and forwardly extending end portions 116 and 118 that are connected by a forwardly and upwardly tapering wall 120. (For ease of reference, the wall 42 is considered to be uppermost, as shown in FIG. 2, and the wall 44 is considered to be lowermost.) The rear of the slot 114 comprises a straight vertical wall 122. In addition, the opening of the end portion 118 is raised to provide a detent 117. More particularly, as the slide 110 moves rearwardly in the recess 108 as indicated by the arrowhead 107, the pin 100 will ride upwardly on the tapering wall 120 until it moves beyond the detent 117 and is received in the end portion 118 of the slot 114. Hence, in effect, the bolt mechanism 64 will be moved to the retracted position so that the lock construction 10 will effectively be operated to the unlocked state. In other words, the posts 92 and 94 will no longer extend across the slots 68 (and the corresponding aligned slots 70 in the bottom wall 46) thereby permitting the lock mechanism 12 to be separated from the mating piece 14. Hence, the slide 110 may be considered to be an opening slide that is movable from a first or forward position to a second or retracted position to effect movement of the pin 100 from a lower or first position to an upper or second position, whereby the bolt mechanism 64 is moved to the retracted position to permit opening of the door 65. More particularly, the pin 100, as noted above, is connected to the U-shaped member 84 via the extension 85 and the posts 92 and 94 are connected to the legs of the member 84. Hence, as the pin moves to the upper position (or toward the wall 42) the member 84 and the posts 92 and 94 will concomitantly move from the solid line position shown in FIG. 3 to the phantom line position shown therein. As a result, the posts 92 and 94 will be moved out of the slots 68 thereby unlocking the door. Moreover, the detent 117 will prevent the pin 100 from moving out of the end portion 118 of the slot 114 so that the bolt mechanism will remain in the retracted position until the door is opened, as noted in greater detail below.

Disposed within the recess 106 for sliding movement therein is a retaining plate 124. The retaining plate 124 is operable to retain the pin 100 in the operate or upper position thereby maintaining the bolt mechanism in the retracted position after the door has been opened. Hence, the lock construction is maintained in the unlocked state until the door is closed. More specifically, the retaining plate 124 is provided with an L-shaped slot 126 having a longitudinally extending leg 128 substantially in alignment with the end portion 118 of the slot 114 in the slide 110, and a transverse leg 130 substantially in alignment with the transverse slot 112 in the bottom wall 46 when the plate is in the retracted position shown in FIG. 5A. Additionally, the plate 124 is provided with a through bore 125 that is adapted to mate with the striker 37. A spring 132 is received within a recess 134 in the bottom wall 46 and abuts the end wall of the recess at one end and the plate 124 at the other end to normally bias the plate forwardly as taken in FIG. 5A. Upstanding guide pins 136 and 138 are provided on the upper surface of the plate 124. The pin 138 is slidingly received in a longitudinally extending slot 140 in the slide 110 and the pin 136 is received within an extension of the recess 134. The guide pin 138 and slot 14 control the travel of the slide 110 to its normal position shown in FIG. 5A, as noted below. A bottom cover plate (not shown) may be provided to cover the recess 104 in the bottom wall 46 thereby to prevent access to the opening assembly 102 when the lock mechanism 12 is separated from the door 65.

An electromechanical device in the form of a solenoid 142 is received within the housing 40, as shown in FIG. 4, and is operable, upon energization, to move the slide 110 rearwardly thereby causing the pin 100 to ride upwardly to its operate position and concomitantly move the bolt mechanism to the retracted position. The solenoid 142 includes a core 144 having an enlarged diameter member 146 thereon. A spring 148 extends between solenoid housing 143 and the member 146 to bias the core 144 outwardly to a forward position. A clevis 150 is connected to the member 146 by a rivet 152. The clevis stradles an upstanding post 154 which is connected to the slide 110. A longitudinally extending slot 156 is provided in the bottom wall 146 of the housing so that the post is free to move rearwardly to effect movement of the slide 110. A pin 158 extends transversely through the post 154 and beyond the arms of the clevis 150 on either side thereof. As will be obvious from a consideration of FIG. 4, when the solenoid 142 is energized, the core 144 will be pulled rearwardly thereby causing rearward movement of the slide 110 via the connection of the clevis 150 and the post 154. Hence, the lock will be operated to the unlocked state.

Figure 1:
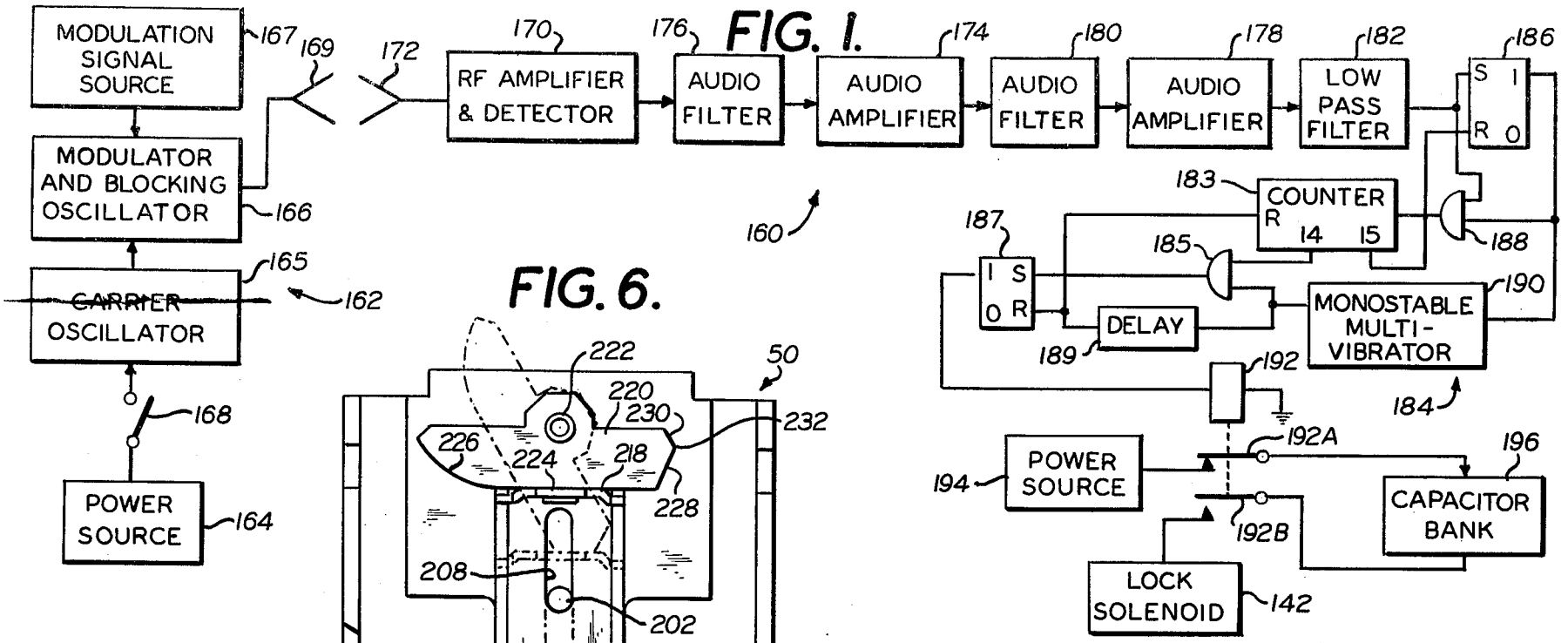
FIG. 1 is a schematic wiring diagram, in block form, of the transmitter and receiver of the lock construction of the present invention.

Energization of the solenoid 142 is controlled by a receiver designated generally by the reference character 160 in FIG. 1. The receiver 160 is adapted to be received within the housing 40 which is fabricated from a non-ferromagnetic material to permit transmission of radio waves to the receiver. As noted above, the receiver 160 is adapted to detect a signal having preselected characteristics and to cause energization of the lock solenoid 142 when such signal is received.

A transmitter, designated generally by the reference numeral 162, is provided to authorized personnel. The transmitter produces the signal having the preselected characteristics so that all authorized personnel can open the lock construction of the present invention. The transmitter 162 comprises a power source 164 connected to a carrier signal oscillator 165 through a manually operable single-pole single-throw switch 168 that is under the control of the operator. The oscillator 165 is connected to a modulator and blocking oscillator unit 166 that modulates the carrier signal with a modulating signal from a modulation signal source 167 and controls the transmission of the modulated carrier. Hence, upon closure of the switch 168, the transmitter will be energized to transmit a pulsed amplitude modulated carrier signal from an antenna 169. That is, the transmitter will transmit pulses of an amplitude modulated carrier signal which pulses have a duration and a repetition rate determined by the blocking oscillator.

As an example, the carrier signal oscillator 165 may be adjusted to generate a signal having a frequency anywhere in the band comprising 260–285 MHz. On the other hand, the modulation signal source 167 may be adjusted to generate an audio frequency signal anywhere in the band comprising 16–33KHz. Additionally, a desired pulse width and repetition rate may be set by properly adjusting the operation of the blocking oscillator. Hence, numerous combinations of audio and carrier frequencies, may be selected for the operation of different lock constructions so that a receiver of one lock construction will be insensitive to a transmitter from another lock construction. This arrangement provides an added degree of safety since the possibility of unauthorized operation of the lock construction is, for all intents and purposes, eliminated. In an actual embodiment, the carrier signal was 260 MHz and the modulating audio signal was 16KHz. The pulse produced was of 1.0 millisecond duration and the time between pulses was 6.0 milliseconds duration. Thus, the repetition rate of the pulsed signal was 142 Hz.

The receiver 160 may comprise a radio frequency amplifier and detector 170 connected to a receiving antenna 172. The stage 170 amplifies the RF signal and detects the audio portion thereof. The detected signal is applied to an audio amplifier 174 through an audio filter 176. The amplifier 174 amplifies the audio signal and applies the amplified signal to another audio amplifier stage 178 through a second audio filter 180. The signal from the amplifier 178 is applied to a detector 184 through a low pass filter 182. More particularly, the detector 184 comprises a bistable multivibrator or flip-flop 186, the set or "S" terminal of which is connected to the filter 182. The "1" output terminal of the flip-flop 186 is connected to an input terminal of an AND gate 188 and a monostable multivibrator or one-shot 190. Another input terminal of gate 188 is connected to filter 182.

The output terminal of AND gate 188 is connected to the input terminal of a decade counter 183. The counter 183 is conventional and counts pulses applied to its input terminals and produces sequential output signals at different terminals corresponding to the number of pulses counted. In the example under consideration, the "15" output terminal of the counter 183 is connected to the reset terminal "R" of flip-flop 186. The "14" output terminal of counter 183 is connected to an input terminal of an AND gate 185, the other input terminal of which is connected to the output terminal of one-shot 190. The output terminal of gate 185 is connected to set terminal "S" of a flip-flop 187, the "1" output terminal of which is connected to relay coil 192. The reset terminals "R" of flip-flop 187 and counter 183 are connected to the output terminals of one-shot 190 through a delay device 189.

The one-shot 190 produces a pulse having a duration sufficient to permit a desired number of received pulses to be counted by counter 183. In the example under consideration, the one-shot produces a 100 ms pulse and the delay device introduces a 10 ms delay.

When the first pulse in a pulse train is received, the flip-flop 186 is set thereby producing a signal at the "1" terminal. This signal enables one terminal of AND gate 188 and triggers one-shot 190 which produces the 100 ms pulse. The 100 ms pulse effectively disables the terminal of AND gate 185 connected thereto. In other words the one-shot 190 normally produces a signal that enables gate 185 but, when the one-shot is triggered, will disable the gate for a 100 ms interval.

The first and the subsequent pulses in the train are also applied to the other terminal of gate 188 and produce pulses at the output thereof which are counted by counter 183. With a pulse repetition rate of 142Hz, 14 pulses will be counted in a 100 ms interval. Hence, if the proper signal is received, the terminal of the gate 185 connected to the "14" terminal of the counter 183 will be enabled substantially simultaneously with the termination of the pulse produced by one-shot 190. Thus, both inputs to gate 185 are enabled thereby producing a signal at the output thereof which sets flip-flop 187 which, in turn energizes relay coil 192.

Receipt of the next pulse increments the counter to energize the "15 " output terminal which thereby resets flip-flop 186 to effectively disable the detector circuit. Additionally, 10 ms after the one-shot pulse has terminated, the delay device 189 will apply a signal to the reset terminals "R" of counter 183 and flip-flop 187 to reset the same.

In addition to the correct carrier and audio frequencies, a pulse train having the correct repetition rate must be received to operate the lock mechanism. If the pulse repetition rate is too low, the one-shot 190 will time-out thereby resetting counter 183 before the "14" count is obtained. If the repetition rate is too high, flip-flop 190 will be reset before the one-shot 190 time-out. Thus, maximum security is provided by the present lock arrangement. Moreover, it is obvious that for different frequencies or repetition rates, appropriate changes in filters and timing devices should be made.

The relay coil 192 controls the operation of normally closed contacts 192A and normally open contacts 192B. That is, when relay coil 192 is energized, the contacts 192A will open and the contacts 192B will close. A source of power 194 is connected to a bank of capacitors 196 through the normally closed contact 192A. The bank of capacitors is adapted to be connected to the lock solenoid 142 through the normally open contacts 192B. Accordingly, when the relay coil 192 is energized, the power source 194 will be disconnected from the bank of capacitors 196 and the capacitor bank will be connected to the lock solenoid 142 through the now closed contacts 192B thereby to energize the lock solenoid.

In practice, it has been found that the capacitor discharge system is necessary to operate the solenoid and to isolate the power source from the load. The solenoid, in an actual embodiment, requires that 15 onces of force be applied to the core in order to retract the slide 110. A capacitor discharge system or capacitor bank 196 produces a sufficient energy output to operate the solenoid within a sufficient interval of time so that the door can be opened quickly after operating the transmitter. That is, in practice the lock solenoid is energized for a sufficient period to thereby pull the slide 110 rearwardly and retract the bolt. The detent 117 maintains the bolt retracted until the door is opened.

The capacitor bank 196 may comprise four electrolytic capacitors, each having a value of 1000 $\mu$f and a rating of 25 volts, connected in parallel. The solenoid 142 may comprise a model SEA 34-12D3 solenoid manufactured by Hi-G, Inc. of 96 Granby Street, Bloomfield, Connecticut 06002.

As noted hereinabove, the receiver 160 is positioned within the housing 40 of the lock mechanism 12. In order to power the receiver and also supply a charging current to the capacitor bank 196, terminals 198 and 200 are provided on the respective walls 42 and 44 of the housing. The terminals are insulatingly mounted on the walls and are connected to the electronic circuitry within the housing. As will be obvious from a consideration of FIG. 2, when the lock mechanism 12 is in engagement with the mating piece 14, the ball contacts 34, which are connected to a source of power, will engage the terminals 198 and 200 thereby to connect the elements within the housing to the source of power.

In operation, it is assumed that the lock construction 10 is in the locked state so that the bolt mechanism is extended and the posts 92 and 94 are received through the apertures 24 in the ears 22 of the mating piece 14. The ends of the posts are received in the recesses 98 in the bolt mechanism mounting block 66. This feature eliminates the possibility of any one inserting an element between the ends of the posts and the mounting block and forcing the posts to the retracted position. In the locked state of the lock construction, the opening mechanism 120 will be in the relative position shown in FIG. 5A. It is to be noted that the pin 100 is captured within the extension 116 of the slot 114 thereby providing an additional degree of safety since it will be impossible to actuate the bolt mechanism until the pin 100 is free of the rearward extension 116.

When authorized personnel desire to open the door 65, the switch 168 on the transmitter 162 is operated to effect transmission of the pulsed carrier signal. The receiver 160 detects the transmitted signal and if the correct carrier frequency, audio amplitude modulation and pulse repetition rate are present, coil 192 will be energized thereby connecting the capatior bank 196 with solenoid 142, in the manner noted above. The core 144 of the solenoid will be retracted and will cause retraction of the slide 110 via the connection comprising the post 154 and clevis 150.

As the opening slide 110 is moved rearwardly (to the left, as taken in FIG. 5A), the pin 100 will be engaged by the wall 120 of the slot 114 thereby causing the pin 100 to ride upwardly to the position shown in FIG. 5B. It is to be noted that the plate 124 will remain in the retracted position shown in FIGS. 5A and 5B for two reasons. In the first place with the door closed, the plate 124 is engaged with the striker 37 so that it cannot move forwardly. In the second place, until the pin 100 reaches its upper position it will abut the rear wall of leg 130 of the L-shaped slot 126 thereby also preventing the plate 124 from being extended. As the pin 100 is moved to the uppermost position, it is received within the extension 118 and retained therein by the raised detent 117. Accordingly, the bolt mechanism 64 will be operated to the retracted position. In other words, as noted above, the posts 92 and 94 will have been withdrawn from the slot 68 thereby disengaging the lock mechanism 12 from the mating piece 14. Even if the solenoid is deenergized at this point, the detent 117 will retain the pin 100 in the slot 118 so that the lock mechanism remains in the open state until the door is opened. At this point, the door may be opened.

Simultaneously with the opening of the door, the plate 124 is no longer restrained and will move forwardly under the influence of the spring 132. That is, when the door is opened, the plate 124 will clear the striker plate 138. Additionally, the pin 100 will be aligned with the leg 128 of the slot 126. Accordingly, as shown in FIG. 5C, the plate 124 will move forwardly with respect to the pin 100 thereby capturing the pin 100 in the leg 128. As the plate 124 moves forwardly, the pin 138 engages the forward wall of the slot 140 thereby moving the slide 110 forwardly so that the pin 100 is moved beyond the detent 117 to the position shown in FIG. 5C. That is, the slide 110 is moved toward its second or normal position until the pin 100 is engaged by the rear wall 122 of the slot 114. However, the pin 100 cannot move to the bottom of the slot or return to the extension 116 because it is being retained in the leg 128 of the plate slot 126. Hence, as long as the door remains open, the lock will remain in its unlocked state. The amount that the plate 124 extends is limited by the engagement of the guide pin 136 with the end wall of the recess 134.

When the door 65 is moved to the closed position the rear edge of the bore 125 in the plate 124 engages the point of the conical projection 38 of the striker 37, as shown in FIG. 10. As the door moves to the fully closed position, the edge of the bore 125 rides downwardly on the projection 38, as indicated by arrowhead 41. Thus, the plate 124 is moved rearwardly. As the plate 124 is moved rearwardly relative to the pin 100 the leg 130 of the slot 126 will again be aligned with the pin 100. Since the bolt mechanism is normally biased to the extended position by the spring 88 (FIG. 3), the pin 100 will immediately move downwardly in the leg 130 of the plate slot. Once the pin is aligned with the extension 116, the slide 110 moves forwardly to its normal or second position under the influence of the solenoid spring 144 thereby capturing the pin 100 in the extension 116, as shown in FIG. 5A. Accordingly, the posts 92 and 94 will again be extended so that the lock mechanism 12 and the mating piece 14 will be engaged. In other words, the lock will automatically have been operated to the closed or locked state.

Figure 6:
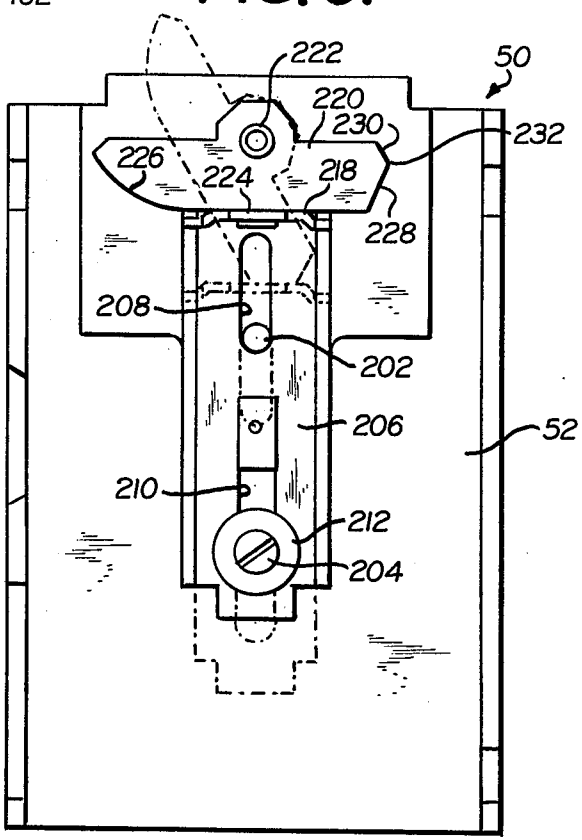
FIG. 6 is a bottom plan view of a cover member, illustrating the elements for manually operating the lock mechanism to the unlocked state.
Figure 7:
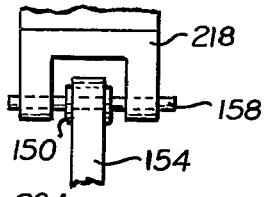
FIG. 7 is a detail view taken along line 7—7 in FIG. 4, with parts removed in the interest of clarity, of the manually operable elements and their relationship to the opening assembly.

The lock mechanism 12 also incorporates provisions for opening the lock manually from the rear or lock side of the door. More particularly, as shown in FIGS. 6 and 7, the bottom surface of the cover plate 50 is provided with a depending guide pin 202 and a depending post 204. A slide 206 is mounted on the cover plate. The slide 206 is provided with longitudinally spaced elongated slots 208 and 210 which respectively slidingly receive the pin 202 and the post 204. An enlarged washer 212 is affixed to the post 204 to maintain the slide in position. A spring 214 extends between the post 204 and an upstanding member 216 on the upper surface of the slide and biases the slide forwardly as shown in FIG. 4. The front edge of the slide 206 is provided with a depending bifurcated member 218 (FIG. 7) having legs in engagement with the pin 158 on each side of the post 154. A lever 220 is fixedly mounted on a pivot pin 222 that is rotatably received through the cover plate. The lever 220 is provided with an intermediate flat surface 224 that normally engages the bifuracted member 218, as shown by the solid line drawing of FIG. 6. One end of the lever 220 is curved at 226 and the other edge of the lever tapers outwardly and upwardly, as taken in FIG. 6, along an edge 228 and then inwardly and upwardly along an edge 230 to define a point 232 between the edges 228 and 230. The pin 222 fixedly receives a handle 234 on the other end thereof.

Rotation of the handle 234 effects concomitant rotation of the lever 220. Accordingly, when it is desired to maintain the lock in the unlocked position, the handle 234 is rotated so that the edge 228 of the lever 220 engages the slide 206 and moves the same rearwardly to the phantom line position shown in FIG. 6. Accordingly, since the bifurcated member 218 is in engagement with the pin 158, the solenoid core 144 will likewise move rearwardly to the retracted position thereby moving the bolt mechanism to the retracted position and unlocking the lock in the manner noted above. The spring 214 urges the slide 206 against the flat edge 228 of the lever thereby maintaining the elements in the position shown by the phantom line drawing of FIG. 6, so that the lock will remain open.

On the other hand, if it is desired to only momentarily open the lock, the handle 234 may be rotated in the opposite direction so that the curved surface 226 engages and moves the slide 206 rearwardly. Upon release of the handle 234, it will be obvious that the spring 214 will again urge the slide forwardly. However, since the slide is now in engagement with the curved surface 226, it will simply rotate the lever 220 back to its home or normal position shown by the solid drawing of FIG. 6 thereby permitting the bolt mechanism to move to the extended position to cause the lock mechanism to resume the locked state.

Under certain conditions, the lock mechanism 12 of the present invention may fail to operate. Accordingly, provision is made to operate the mechanism by manual means so that the lock can be operated to the unlocked state. More specifically, as shown in FIG. 5A, a circular recess 236 is provided that is defined in part by the bottom wall 46 of the housing and the plate 124. The recess 236 provides access to the edge of the slide 110. The edge of the slide in the vicinity of the recess 236 is provided with teeth 238.

If it is necessary to operate the lock manually, a hole which is in alignment with the recess 236 is drilled through the door 65. A shaft 240 having a gear 242 thereon, as shown by the phantom line of FIG. 5A, is inserted through the hole in the door until the gear 242 engages the teeth 238 on the slide 110. The other end of the shaft is provided with a handle 244 that may be rotated whereby the slide 110 is moved to the retracted position by the engagement of the gear 242 with the teeth 238. Thus movement of the slide 110 to the retracted position will similarly move the posts 92 and 94 to the retracted position thereby permitting the door to be opened.

Accordingly, a lock construction has been disclosed which may be operated from a remote source without the necessity for an external member to be inserted into the lock thereby rendering the lock virtually pick-proof.

While a preferred embodiment of the invention has been shown and described herein it will become obvious that numerous omissions, changes and additions may be made in such embodiment without departing from the spirit and scope of the present invention.

What is claimed is:

1. A lock construction for a door or the like comprising a mating piece adapted to be mounted on a door jamb; said mating piece having at least an outwardly extending ear provided with an aperture; and a lock mechanism adapted to be mounted on a door; said lock mechanism comprising: a lock housing having at least a slot sized and positioned to receive said mating piece ear therein when the door is closed, bolt means movably mounted on the housing for movement between an extended position wherein said bolt means extends through said ear aperture and a retracted position wherein said bolt means and said ear are disengaged, said bolt means comprising an outwardly extending pin movable from a lower position corresponding to the extended position of said bolt means to an upper position corresponding to the retracted position of the bolt means, and spring means for normally biasing said pin to said lower position whereby said bolt means is normally in the extended position; a slide mounted for movement between an extended and a retracted position in said housing, biasing means for biasing siad slide to the extended position, a tapering slot in said slide receiving said pin therethrough whereby movement of said slide from said extended to said retracted position affects concomitant movement of said pin from said lower to said upper position, a retaining plate mounted for movement in said housing between a retracted and an extended position, said plate having a slot having a transverse portion receiving said pin therein for movement between said lower and upper positions, and a longitudinal portion positioned to be aligned with said pin when said pin is in said upper position, a spring normally biasing said plate to said extended position, whereyb said plate moves to the extended position when said pin is moved to the upper position to receive said pin in said longitudinal portion of said plate slot, striker means on said mating piece for moving said plate to said retracted position to permit movement of said pin to said lower position when said ear is received in said housing slot, and actuating means for moving said slide to said retracted position.

2. A lock construction as in claim 1, in which said actuating means comprises an electromechanical device for moving said slide to said retracted position when energized, an energy source for energizing said electromechanical device, and a radio signal receiver responsive to the reception of a preselected signal for connecting said energy source with said electromechanical device for a preselected interval of time.

3. A lock construction as in claim 1, in which said tapering slot comprises a detent at the end thereof for removably retaining said pin in said upper position.

4. A lock construction as in claim 3, and means on said plate engageable with said slide for moving said slide to said extended position as said plate moves to said extended position.

5. A lock mechanism for a door or the like adapted to engage the mating piece to lock the door comprising:

a lock housing bolt means movably mounted on said housing for movement between an extended position wherein said bolt means engages with the mating piece and a retracted position wherein said bolt means and the mating piece are disengaged;

said bolt means comprising an operating member movable from a first position corresponding to the extended position of said bolt means to a second position corresponding to the retracted position of said bolt means, and spring means for normally biasing said operating means to said first position whereby said bolt means is normally in the extended position;

opening means connected with said operating means and movable upon actuation from a first to a second position to move said operating member from said operating member first position to said operating member second position;

retaining means for retaining said operating member in said second position;

actuating means connected to said opening means for actuating said opening means;

said retaining means being operable from a retracted position to an extended position when said retaining means retains said operating member in said second position, biasing means for normally urging said retaining means to the extended position;

and striker means adapted to be mounted on one of the door or a door jamb, mounting means on said lock housing for mounting said lock housing on the other of said door or door jamb, said striker means being positioned to engage and move said retaining means to the retracted position as the door is closed to permit movement of said operating member to the first position, whereby said bolt means is moved to the extended position to engage with the mating piece, said operating member comprising a projecting pin, and said opening means comprising a slide within said housing mounted for movement between an extended position corresponding to said first position of said opening means and a retracted position corresponding to said second position of said opening means, a tapering slot in said slide receiving said pin therethrough and positioned to move said pin from a lower position corresponding to said operating member first position to an upper position corresponding to said operating member second position when said slide is moved from the extended to the retracted position, said actuating means comprising biasing means for normally biasing said slide to the extended position.

6. A lock mechanism as in claim 1, in which said slot comprises a detent for removably retaining said pin in said upper position.

7. A lock mechanism as in claim 1, in which said slide is provided with teeth adjacent an edge thereof, and separable gear means adapted to engage said slide teeth to move said slide to said retracted position upon rotation of said gear means, whereby said bolt means is moved to said retracted position in the absence of operation of said actuating means.

8. A lock mechanism as in claim 1, in which said retaining means comprises a movable plate, a slot in said plate having a first portion slidingly receiving said pin for movement between said lower and upper positions, and a second portion extending parallel to the direction of movement of said plate and positioned to be in alignment with said pin when said pin is in said upper position, said biasing means urging said plate to the extended position whereby said plate moves to the extended position to receive said pin within said second portion of said slot when said pin is aligned with said slot, to prevent movement of said pin to the lower position.

9. A lock mechanism as in claim 8, in which said striker means comprises a mating piece, and a striker member mounted on said mating piece and adapted to engage and move said plate to the retracted position, whereupon said pin is moved from said second portion to said first portion of said slot, whereby said spring means biases said pin to said lower position so that said bolt means is moved to the extended position to effect engagement of said lock mechanism with said mating piece.

10. A lock mechanism as in claim 1, in which said actuating means comprises an electromechanical device for moving said opening means to the second position, an energy source for energizing said electromechanical device, and a receiver responsive to the reception of a preselected signal for connecting said energy source with said electromechanical device.

11. A lock mechanism as in claim 10, in which said source of energy comprises a plurality of charged capacitors, and charging means for maintaining said capacitors charged in the absence of said preselected signal.

12. A lock mechanism as in claim 10, in which said preselected signal comprises a pulse train wherein each pulse has a predetermined width, said receiver comprising counting means for connecting said source of energy with said electromechanical device in response to a preselected count of said pulses, and timing means for deenergizing said counting means within a selected interval of time from receipt of the first pulse in said train.

13. A lock mechanism as in claim 10, and terminal means on said lock mechanism housing connected in circuit with said energy source and said receiver, and contact means on said striker means adapted to be connected to a source of power and engageable with said terminal means when said bolt means is engaged with said striker means to supply power to said energy source and said receiver.

14. A lock mechanism as in claim 10, and manually operable means on said housing for manually operating said actuating means to move said bolt means to the retracted position.

* * * * *